United States Patent [19]

Sze et al.

[11] 3,932,266

[45] Jan. 13, 1976

[54] SYNTHETIC CRUDE FROM COAL

[75] Inventors: Morgan C. Sze, Upper Montclair; George J. Snell, Fords, both of N.J.

[73] Assignee: The Lummus Company, Bloomfield, N.J.

[22] Filed: Dec. 12, 1973

[21] Appl. No.: 423,903

[52] U.S. Cl. ..... 208/10; 208/8

[51] Int. Cl.[2] ..... C10G 1/04

[58] Field of Search ..... 208/8, 10

[56] References Cited

UNITED STATES PATENTS

| | | | |
|---|---|---|---|
| 2,987,465 | 6/1961 | Johanson | 208/10 |
| 3,583,900 | 6/1971 | Gatsis | 208/8 |
| 3,598,718 | 8/1971 | Gleim et al. | 208/8 |
| 3,687,837 | 8/1972 | Fiocco et al. | 208/8 |
| 3,790,467 | 2/1974 | Fiocco et al. | 208/8 |
| 3,852,183 | 12/1974 | Snell | 208/8 |
| 3,856,675 | 12/1974 | Sze et al. | 208/8 |

*Primary Examiner*—Delbert E. Gantz
*Assistant Examiner*—James W. Hellwege
*Attorney, Agent, or Firm*—Marn & Jangarathis

[57] ABSTRACT

Coal is hydroliquefied with the hydrogen consumption being limited to that required for effective liquefaction and/or deashing. Ash is removed and the liquid coal product hydrotreated in a second stage to produce synthetic crude.

14 Claims, 1 Drawing Figure

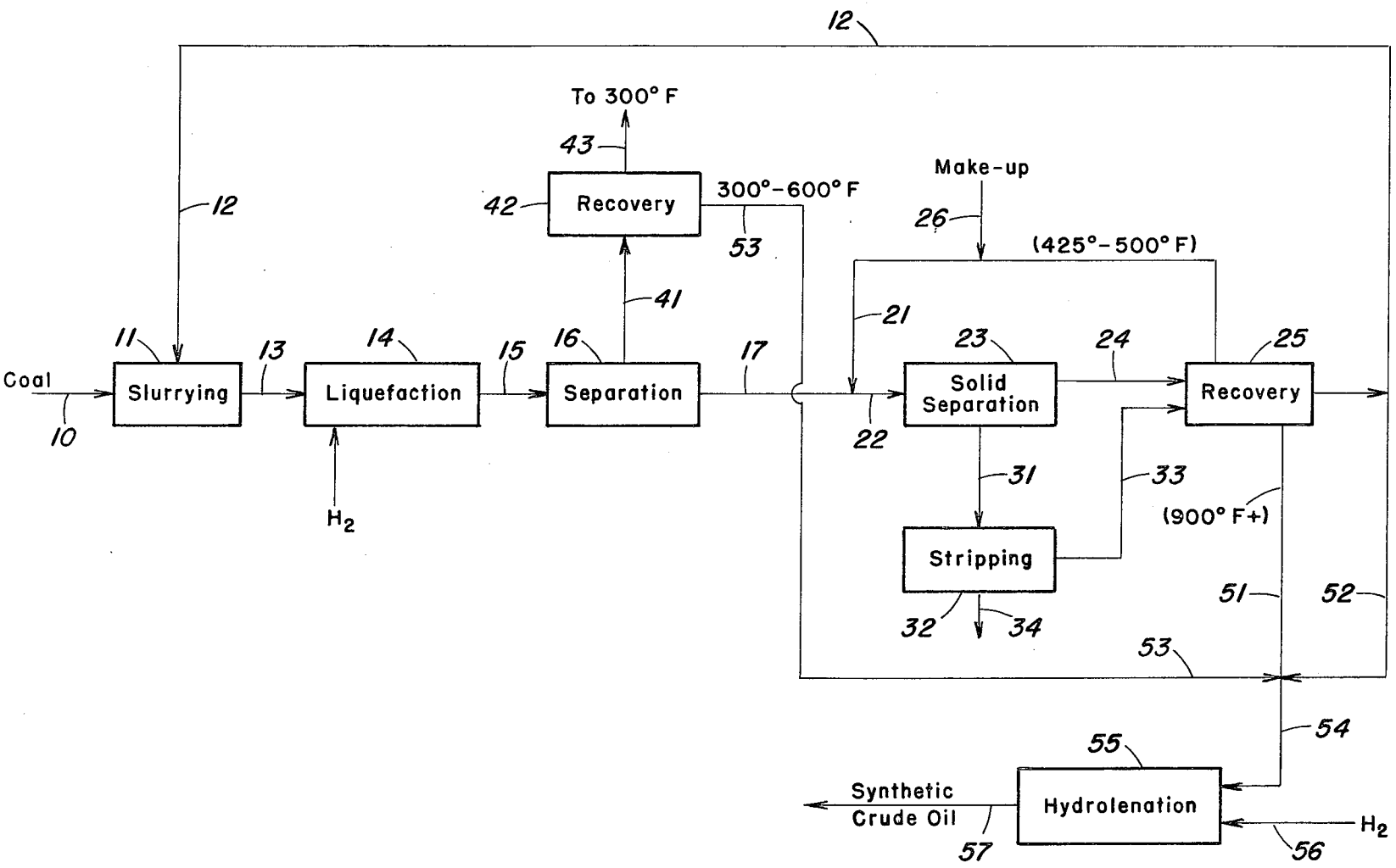
Coal
10
Slurrying
11
12
13
Liquefaction
14
$H_2$
15
Separation
16
17
Recovery
42
41
To 300° F
43
300°-600° F
53
Make-up
26
(425°-500° F)
21
22
Solid Separation
23
24
Recovery
25
31
Stripping
32
34
33
(900° F+)
51
52
53
54
Hydrolenation
55
$H_2$
56
Synthetic Crude Oil
57

SYNTHETIC CRUDE FROM COAL

This invention relates to the production of synthetic crude oil and more particularly to the production of synthetic crude oil from coal.

Coal can be converted to valuable products by subjecting coal to solvent extraction, with or without hydrogen, to produce a mixture of coal extract and undissolved coal residue.

Attempts to provide an effective process for converting coal to petroleum type products have not been generally successful as a result of the difficulties encountered in efficiently and effectively separating insoluble residues and in efficiently and effectively adding hydrogen to the hydrogen lean coal. Thus, for example, to convert a highly volatile bituminous coal to a synthetic crude the hydrogen to carbon atomic ratio must be increased from about 0.79 to about 1.8.

Accordingly, an object of the present invention is to provide a new and improved process for producing synthetic crude oil.

Another object of the present invention is to provide a new and improved process for producing synthetic crude oil from coal.

These and other objects of the present invention should be more readily apparent from reading the following description thereof.

In accordance with the present invention, a synthetic crude is produced from coal by initially hydrogenating coal in the presence of a coal liquefaction solvent to effect liquefaction of the coal, with only a portion of the hydrogen required for producing the synthetic crude being consumed during the initial hydrogenation. The initial hydrogenation is for the purpose of liquefying the coal and/or providing optimum deashing. The liquid coal product from the initial hydrogenation is then deashed and the essentially ash-free liquid coal product is then subjected to a second hydrogenation wherein sufficient hydrogen is added to provide a synthetic crude. Thus, the hydrogen requirements for producing synthetic crude from coal are added in two stages, with the liquefied coal product being deashed between the two stages, and the first stage being employed for hydroliquefaction of the coal.

The initial hydrogenation of the coal in the presence of a coal liquefaction solvent may be catalytic or non catalytic, with catalytic hydroliquefaction being preferred. As representative examples of suitable catalysts, there may be mentioned: cobalt-molybdate, nickel molybdate, tungsten nickel sulfide, tungsten sulfide, etc., generally supported on alumina or silica-alumina with a cobalt or nickel molybdate catalyst supported on alumina or silica-alumina being preferred. The catalytic liquefaction may be effected by any of the wide variety of procedures known in the art, including catalyst added as a powder, a fixed catalyst bed, a fluidized catalyst bed or an ebullating bed, with an upflow fluidized or ebullating bed being preferred.

The initial hydrotreating is generally effected at: a temperature from about 650° to about 900°F, preferably from 750° to 850°F; an operating pressure from about 500 psig to about 4000 psig; a hydrogen partial pressure from about 500 to 3000 psia; and a liquid hourly space velocity from about 0.5 to 4.0 hr. $^{-1}$. The above conditions are only illustrative and the selection of optimum conditions is deemed to be within the scope of those skilled in the art from the teachings herein.

As hereinabove noted, the initial hydrogenation is for the purpose of liquefying the coal and, accordingly, hydrogen consumption is limited in the first stage to no greater than 15,000 SCF/ton MAF (moisture ash free) coal, and preferably no greater than 12,000 SCF/ton MAF coal. In general, the hydrogen consumption, in the first stage, ranges from 4,000 to 12,000 SCF/ton MAF coal.

The insoluble material is preferably separated from the coal liquefaction product by the use of a liquid promotor having an aromaticity less than that of the liquefaction solvent to enhance and promote the separation of insoluble material and provide a liquid coal extract essentially free of insoluble material.

The liquid which is employed to enhance and promote the separation of insoluble material from the coal liquefaction product is generally a hydrocarbon liquid having a characterization factor (K) of at least about 9.75 and preferably at least about 11.0 wherein:

$$K = \frac{\sqrt[3]{T_B}}{G}$$

wherein $T_B$ is the molal average boiling point of the liquid (°R); and G is specific gravity of the liquid (60°F./60°F.).

The characterization factor is an index of the aromaticity/ parafinicity of hydrocarbons and petroleum fractions as disclosed by Watson & Nelson Ind. Eng. Chem. 25,880 (1933), with more parafinic materials having higher values for the characterization factor (K). The promoter liquid which is employed is one which has a characterization factor (K) in excess of 9.75 and which is also less aromatic than the liquefaction solvent; i.e., the characterization factor K of the promoter liquid has a value which is generally at least 0.25 higher than the characterization factor of the liquefaction solvent.

The following Table provides representative characterization Factors (K) for various materials:

Table

| | |
|---|---|
| Anthracene | 8.3 |
| Naphthalene | 8.4 |
| 425–500°F. Coal Tar Distillate | 8.8 |
| 550–900°F. Coal Tar Distillate | 9.1 |
| 600–900°F. Coal Tar Distillate | 9.0 |
| 400–450°F. Coal Tar Distillate | 9.4 |
| Benzene | 9.8 |
| Tetrahydronaphthalene | 9.8 |
| o-xylene | 10.3 |
| Decahydronaphthalene | 10.6 |
| Cyclohexane | 11.0 |
| 425–500°F Boiling Range Kerosene | 11.9 |
| n-Dodecylbenzene | 12.0 |
| Propylene Oligomers (pentamer) | 12.2 |
| Cetene | 12.8 |
| Tridecane | 12.8 |
| n-Hexane | 12.9 |
| Hexadecane or cetane | 13.0 |

The liquid which is used to enhance and promote the separation of insoluble material is further characterized by a 5 volume percent distillation temperature of at least about 250°F. and a 95 volume percent distillation temperature of at least about 350°F. and no greater than about 750°F. The promoter liquid preferably has a 5 volume percent distillation temperature of at least about 310°F. and most preferably of at least about 400°F. The 95 volume percent distillation temperature is preferably no greater than about 600°F. The most preferred promoter liquid has a 5 volume percent distillation temperature of at least about 425°F. and a 95 volume percent distillation temperature of no greater than about 500°F. It is to be understood that the promoter liquid may be a hydrocarbon; e.g., tetrahydronaphthalene, in which case the 5 volume percent and 95 volume percent distillation temperatures are the same; i.e., the hydrocarbon has a single boiling point. In such a case, the boiling point of the hydrocarbon must be at least about 350°F. in order to meet the requirement of a 5 volume percent distillation temperature of at least about 250°F. and a 95 volume percent distillation temperature of at least about 350°F. The promoter liquid is preferably a blend or mixture of hydrocarbons in which case the 5 volume percent and 95 volume percent distillation temperatures are not the same.

The 5 volume and 95 volume percent distillation temperature may be conveniently determined by ASTM No. D 86-67 or No. D 1160 with the former being preferred for those liquids having a 95 percent volume distillation temperature below 600°F. and the latter for those above 600°F. The methods for determining such temperatures are well known in the art and further details in this respect are not required for a full understanding of the invention. It is also to be understood that the reported temperatures are corrected to atmospheric pressure.

As representative examples of such liquids, there may be mentioned: kerosene or kerosene fractions from paraffinic or mixed base crude oils; middle distillates, light gas oils and gas oil fractions from paraffinic or mixed based crude oils; alkyl benzenes with side chains containing ten or more carbon atoms; paraffinic hydrocarbons containing more than 12 carbon atoms; white oils or white oil fraction derived from crude oils; alpha olefins containing more than 12 carbon atoms; fully hydrogenated naphthalenes and substituted naphthalenes; propylene oligomers (pentamer and higher); tetrahydronaphthalene, heavy naphtha fractions, etc. The most preferred liquids are kerosene fractions; white oils; fully hydrogenated naphthalenes and substituted naphthalenes; and tetrahydronaphthalene.

The amount of liquid promoter used for enhancing and promoting the separation of insoluble matter from the coal liquefaction product will vary with the particular liquid employed, the coal liquefaction solvent, the coal used as starting material and the manner in which the liquefaction is effected. As should be apparent to those skilled in the art, the amount of liquid promotor used should be minimized in order to reduce the overall costs of the process. It has been found that by using the liquid of controlled aromaticity, in accordance with the teachings of the present invention, the desired separation of insoluble material may be effected with modest amounts of liquid promoter. In general, the weight ratio of liquid promoter to coal solution may range from about 0.2:1 to about 3.0:1, preferable from about 0.3:1 to about 2.0:1 and, most preferably from about 0.3:1 to about 1.5:1. In using the preferred promoter liquid which is a kerosene fraction having 5 percent and 95 percent volume distillation temperatures of 425°F. and 500°F. respectively, promoter liquid to coal solution weight ratios in the order of 0.4:1 to 0.6:1 have been particularly successful. It is to be understood, however, that greater amounts of liquid promoter may be employed but the use of such greater amounts is uneconomical. In addition, the use of an excess of liquid promoter may result in the precipitation or separation of an excessive amount of desired coal derived products from the coal extract. More particularly, as the amount of liquid promoter employed is increased, a greater amount of ash is separated from the coal solution, but such increased ash separation is accompanied by an increased separation of desired coal derived products from the coal solution. By using the liquid promoters as herein described, not only may modest amounts of solvent be employed, but in addition, ash may be effectively separated from the coal solution; e.g., in amounts greater than 99 percent, without an excessive loss of desired coal derived products.

More particularly, coal, such as bituminous coal, on a moisture ash free basis (MAF) may contain from about 5 to about 10 percent of insoluble material, such as fusain, and accordingly, at a minimum, from about 5 to about 10 percent, of the MAF coal, is lost in the process. In the recovery of coal derived products by a solvation process, the potential product loss is measured by the amount of 850°F+ product which is not recovered from the coal in that it is this fraction, which includes insoluble coal material, such as fusain, which can not be recovered from the residual solid product of the coal deashing. In accordance with the present invention, on a MAF coal feed basis, product loss of 850°F+ components (on an ash free basis) can be maintained at a value of no greater than about 30 percent, by weight, and preferably no greater than about 25 percent by weight. In general, the loss of 850°F+ products, on a MAF coal basis, is from about 10 to about 25 percent, by weight. In addition, the net coal product (the extracted carbonaceous matter, excluding promoter liquid, liquefaction solvent and gas make), hereinafter sometimes referred to as "coal product," contains less than about 0.5 percent insoluble material, all by weight. The specific amount of insoluble material which is permitted to be present in the coal product is dependent upon the product standards, and the deashing is controlled in order to provide the required specifications. Based on an Illinois No. 6 type of coal, the production of a coal product having less than 0.05 percent, by weight, insoluble material, corresponds to 99+% ash removal, but as should be apparent to those skilled in the art, the percent ash removal to provide a coal product having the required minimum amount of insoluble material is dependent upon the initial ash content of the coal. Thus, in accordance with the present invention, the liquid promoter is added to the coal solution in an amount, as hereinabove described to provide a coal product in which insoluble material is present in an amount of less than about 0.05 percent, by weight, with the loss of 850°F+ product being from about 10 to about 25 percent, by weight, on a MAF coal feed basis; i.e., from about 70 to about 90 percent, by weight, of the MAF coal feed is recovered as either gas make or liquid fuel product.

The liquid promoter may also be prepared by blending a material having a characterization factor below 9.75 with a material having a characterization factor above 9.75, provided the blend has a characterization factor above 9.75 and the boiling properties, as hereinabove described. The use of blended material is a convenient manner of regulating the characterization factor.

As a further alternative, the liquid promoter may be an indigenous promoter which is produced by hydrotreating a portion of the recovered coal product, as described in application Ser. No. 304,320 filed on Nov. 7, 1972 now U.S. Pat. No. 3,852,182.

The separation of the insoluble material from the coal extract is generally effected at a temperature from about 300°F. to about 600°F., preferably from about 350°F. to about 500°F., and at a pressure from about 0 psig. to about 500 psig., preferably at a pressure from about 0 psig to about 300 psig. It is to be understood that higher pressures could be employed, but as should be apparent to those skilled in the art, lower pressures are preferred. The insoluble material is preferably separated by gravity settling with the essentially insoluble-free coal extract being recovered as an overflow and the insoluble material as underflow. In such gravity settling, the amount of underflow should be minimized in order to minimize the loss of heavier products in the underflow. The underflow withdrawal rate to obtain desired results is deemed to be within the scope of those skilled in the art. In general, such a rate is from about 20 to about 25 wt. % of the total feed (liquefaction product and promoter liquid). The residence time for such settling is generally in the order of from about 0.5 to about 6 hours and preferably from about 0.5 to 3.0 hours.

Although ash is preferably separated from the coal solution employing a promoter liquid, as hereinabove described, it is to be understood that ash removal could be effected by other techniques such as filtration, centrifugation, etc. with less effective results.

All or a portion of the ash free net coal liquefaction product is then used as feed to the second hydrotreating for the production of synthetic crude. In general, the feed to the second hydrotreating is comprised of the net 300°F+ ash free coal liquefaction product, but it is to be understood that only a portion of the net 300°F+ ash free product could be used as feed, and that such portion can be comprised of components which boil over the entire 300°F+ range of coal product or only over a portion of such range.

The ash free liquid coal liquefaction product is then subjected to a second stage hydrogenation wherein the feed is hydrogenated and/or hydrocracked to produce a synthetic crude. In the second stage hydrotreating, hydrogen consumption is in the order of 7500 to 20,000 SCF/ton of MAF original coal feed, with the specific amount of hydrogen consumption being dependent upon the desired average hydrogen/carbon atomic ratio of the synthetic crude product. Thus, for example, if a crude having an average hydrogen to carbon atomic ratio in the order of 1.8 is desired the hydrogen consumption is generally in the order of 15,000 to 20,000 SCF per ton of original MAF coal. If a lower average carbon/hydrogen atomic ratio is desired, then hydrogen consumption will generally be in the order of 7500 to 15,000 SCF/ton original MAF coal. The hydrogen consumption is easily controlled by adjusting space velocity and/or temperature and the selection of optimum conditions in this respect is within the scope of those skilled in the art from the present teachings.

The hydrotreating is effected in the presence of a suitable catalyst, such as metals of sub-groups V to VIII of the Periodic Table. A preferred catalyst is one containing a metal oxide or sulfide of Group VI; e.g., molybdenum, combined with a transition group metal oxide or sulfide, such as cobalt or nickel. As representative examples, there may be mentioned: cobalt or nickel molybdate on alumina or silica-alumina, nickel tungsten sulfide on alumina or silica-alumina and the like. A dual function catalyst which exhibits good hydrogenation activity toward mono- and polycylic aromatic compounds and also provides a cracking and/or hydrocracking function is especially preferred, particularly where lighter products are preferred. A series of hydrotreating reactions containing different catalysts can also be used. For example, a first series of reactors could contain a desulfurization/denitrification catalyst and a second series could contain a noble metal hydrogenation catalyst with an appropriate degree of hydrocracking activity. These and other operations should be apparent to those skilled in the art.

The second stage hydrotreating is generally effected at temperatures from 500° to 900°F., preferably from 600° to 850°F. operating pressures of from 500 to 5,000 psig, preferably 1,000 to 3,000 psig; and liquid hourly space velocities from 0.5 to 4.0 hr.$^{-1}$, preferably 0.8 to 1.6 hr.$^{-1}$. It is to be understood that the above conditions are illustrative and are not intended to limit the scope of the present invention.

The synthetic crude oils produced in accordance with the present invention have a low sulfur and ash content and are characterized by a hydrogen to carbon atomic ratio from about 1.2 to about 1.8. In addition, the synthetic crude oil produced in accordance with the invention is preferably one which is characterized by a 10 volume percent distillation temperature of at least 90°F. and 70 volume percent distillation temperature of no greater than 900°F. Accordingly, no more than 30 volume percent of the crude oil boils above 900°F., but, as should be apparent, the crude oil need not contain any components which boil above 900°F.

The invention will be further described with respect to an embodiment thereof illustrated in the accompanying drawing, but it is to be understood that the scope of the invention is not to be limited thereby.

Referring to the drawing, ground or pulverized coal, generally bituminous, sub-bituminous or lignite, preferably bituminous coal of high volatility, in line 10 is introduced into a coal solvation and slurrying zone 11 along with a coal liquefaction solvent in line 12. The coal liquefaction solvent may be any one of the wide variety of coal liquefaction solvents used in the art, including both hydrogen donor solvents, non-hydrogen donor solvents and mixtures thereof. These solvents are well known in the art and, accordingly, no detailed description thereof is deemed necessary for a full understanding of the invention. As particularly described, the coal liquefaction solvent is a 600°F. – 900°F. solvent which is recovered from the coal liquefaction product and which has not been subjected to hydrogenation subsequent to the recovery thereof. The solvent is added to the coal in an amount sufficient to effect the desired liquefaction, and in general, is added in an amount to provide a solvent to coal weight ratio from about 1:1 to about 20:1 and preferably from about 1.5:1 to about 5:1.

A coal paste is withdrawn from zone 11 through line 13 and introduced into a coal liquefaction zone 14 wherein, as known in the art, the coal is converted to liquid products. The liquefaction zone 14 is operated as known in the art and may be catalytic or non-catalytic. The hydrogenation may be effected in a fixed catalyst bed, fluidized catalyst bed or an expanded or ebullating bed, preferably an expanded bed as described in U.S. Pat. No. 2,987,465 to Johanson. As hereinabove described, the hydrotreating is preferably controlled to produce a coal liquefaction product having a Deashability Index of from about 10 to about 18. The hydrotreating, as known in the art, reduces the sulfur and nitrogen content of the recovered liquid coal product.

A coal liquefaction product, comprised of a liquid coal extract of dissolved carbonaceous matter in the coal liquefaction solvent and insoluble material (ash and undissolved coal) is withdrawn from the liquefaction zone 14 through line 15 and introduced into a separation zone 16 to separate from the coal liquefaction product those materials boiling up to about 600°F. in order to facilitate the subsequent separation of the promoter liquid used for deashing. The separation zone 16 may include an atmospheric or vacuum flashing chamber or tower.

The materials boiling up to about 600°F. are recovered from zone 16 through line 41 and are introduced into a separation and recovery zone 42, such as a fractionator, to recover lighter components boiling up to, for example, about 300°F. and a 300°F. – 600°F. fraction. The lighter components are recovered as a raw naphtha product through line 43.

A coal liquefaction product, free of components boiling up to about 600°F., withdrawn from separation zone 16 through line 17, is mixed with promoter liquid in line 21 of controlled aromaticity, i.e., the characterization factor of the promoter liquid has a value which is generally at least 0.25 unit greater than the characterization factor of the coal liquefaction solvent. As particularly described, the promoter liquid is a kerosene fraction which has 5 volume percent and 95 volume percent distillation temperatures which fall within the range from about 425° – 500°F. and is derived from a naphthenic or paraffinic crude oil.

The combined stream of coal liquefaction product and promoter liquid in line 22 is introduced into a gravity separation zone 23, comprised of a gravity settler which may be any one of those known in the art, wherein an essentially solids free overflow is separated from a solid containing underflow.

The overflow essentially free of insoluble material, is withdrawn from separation zone 23 through line 24 and introduced into a recovery zone 25 for recovering promoter liquid and various fractions of the coal extract. The recovery zone 25 may be comprised of one or more fractionators to distill various fractions from the product. As particularly described, the recovery zone is operated to recover a first fraction having 5 and 95 percent volume distillation temperature of from 425° to 500°F., which is to be used as the promoter liquid for enhancing and promoting separation of solid material from the coal liquefaction product; a second fraction (600° – 900°F) a portion of which may be used as the coal liquefaction solvent in line 12 and a further portion thereof recovered as product, and a residual product (+900°F) of low ash and reduced sulfur content. The promoter liquid recovered in the recovery zone is admixed with the liquefaction product in line 17 and makeup may be provided through line 26.

The underflow containing dispersed insoluble material withdrawn from separation zone 23 through line 31 is introduced into a stripping zone 32 wherein material boiling below about 900°F is stripped therefrom and introduced into the recovery zone 25 through line 33. The ash rich stripper bottoms in line 34 may then be subjected to calcination or coking. Alternatively, part of the stripper bottoms may be used as feedstock to a partial oxidation process for producing hydrogen. As a further alternative, a portion of the stripper bottoms may be used for plant fuel. These uses and others should be apparent to those skilled in the art from the teachings herein. In accordance with the present invention, the stripper bottoms in line 34 contains from about 10 to about 30 percent, by weight, of the MAF coal. In addition the coal product (the product recovered from zones 16 and 25, excluding liquefaction solvent and promoter liquid) contains less than 0.05 percent, by weight, of insoluble material.

The residual product (+900°F) recovered from zone 25 in line 51, any net 600° – 900°F. product in line 52 and 300°F – 600°F product from zone 41 in line 53 are combined in line 54, as feed, to a second hydrotreating zone 55 which is supplied with hydrogen through line 56.

The second hydrotreating zone 55 is operated as hereinabove described to produce a synthetic crude of low sulfur and low ash, which is recovered through line 57.

The invention will be further described with respect to the following example, but the scope of the invention is not to be limited thereby.

EXAMPLE 1

A slurry, consisting of 40 wt% bituminous coal and 60 wt% of a 600°–900°F boiling range heavy coal derived paste solvent, is fed along with hydrogen through a preheater and into an upflow, expanded bed catalytic reactor. The reactor contains a spherical cobalt molybdate catalyst in sulfided form. A liquid hourly space velocity, operating temperature, operating pressure, and hydrogen feed rate of 2.0 hr. $^{-1}$, 790° – 830°F., 1400 psig, and 23 SCF/lb coal respectively are maintained throughout the run.

Reactor effluent is quickly cooled to 200°F and routed to one of two high pressure gas/liquid separators piped in parallel. Gaseous components are continuously separated from liquid components in the said separator which is operated under automatic pressure control. The standby or other separator is placed on the line when the liquid contents of the separator in use reaches about 80 percent of its total volume. Its liquid contents are discharged to a water cooled, low pressure separator and subsequently drummed. The contents of the drum or drums in the case of a long run will be referred to as a coal product solution for purposes of identification. A composite aliquot sample of the coal product solution prepared above was analyzed via vacuum distillation methods and the cuts derived therefrom were subjected to an ash and elemental analysis (C, H, N, S, O). The liquid coal product portion of the above reactor effluent solution has a hydrogen to carbon atomic ratio of about 0.95.

EXAMPLE 2

The ash rich product solution prepared in Example 1 is continuously fed through a preheater and into an equilibrium flash vaporization unit operating at atmospheric pressure and 600°F. Overhead product from this operation after condensation and cooling is labeled cut number 1. Residual ash containing product from this operation after cooling to 150° – 180°F was stored in a steam heated agitated storage tank under a nitrogen environment. For purpose of identification the above residual product will be referred to as atmospheric flashed coal product solution.

Atmospheric flashed coal product solution and a promoter liquid having a characterization factor of about 11.9 are continuously fed to an in-line mixer operating at about 500°F. The admixture from the in-line mixer is routed to a heated gravity settler from which a substantially ash free overflow and ash enriched underflow stream are continuously withdrawn. Table 1 below is a compilation of the process parameters used in this example.

TABLE I

PROCESS PARAMETER SUMMARY for EXAMPLE 2

| | |
|---|---|
| Promoter Liquid | 425–500°F boiling range distillate |
| Characterization Factor | 11.9 |
| Promoter Liquid/atm. Flash Coal Product Solution Wt. Ratio Used | 0.5 |
| Mixing Temperature, °F | 500 |
| Gravity Settler Operating Temperature, °F | 500 |
| Gravity Settler Operating Pressure, psig | 100 |
| Gravity Settler Residence Time, hrs. | 3.0 |
| Underflow Rate, Wt% of Total Settler Feed | 22 |

A representative aliquot sample of the composite overflow stream taken after the run was terminated exhibited an ash content <.01 wt%, which is equivalent to a 99+% ash removal from the coal product portion of the overflow stream.

Both the ash lean overflow stream and ash enriched underflow stream are fractionated via vacuum distillation into several cuts. These cuts will be referred to as cut 2, cut 3, and the residue for reference purposes. Cut 2 includes all components boiling below a nominal 600°F at atmospheric pressure and for the case in point this cut is substantially pure promoter liquid. The boiling range of cut 3 is 600°–900°F (nominal temperature) corrected to 760mm Hg absolute pressure. Cut 2 and cut 3 derived from both the overflow and underflow streams are blended separately into a composite cut 2 and composite cut 3. An amount of material equivalent to the amount heavy 600°–900°F coal derived paste oil used in Example 1 is removed from composite cut 3 and the net amount of cut 3 composite was blended with cut number 1 generated in Example 1 and lastly this admixture is blended with the ash lean +900°F residual product derived from the overflow stream. The resultant final blend is termed a net coal product for purposes of identification. This net coal product has an ash content of about .05 wt% and ball and ring softening point less than 150°F.

EXAMPLE 3

The ash lean net coal product prepared in Example 2 is charged to a steam jacketed agitated feed tank. Said net coal product along with hydrogen are fed through a preheater and into the top of a fixed bed catalytic reactor operating at 650°F inlet temperature. The operating parameters used in this example are summarized below in Table 2.

TABLE 2

FIXED BED CATALYTIC REACTOR OPERATING PARAMETERS

| | |
|---|---|
| Catalyst Used | Nickel Tungsten Sulfide on Silica-Alumina Support |
| Liquid Hourly Space Velocity, $hr^{-1}$ | 1.3 |
| Hydrogen Feed, SCF/gal of Feed | 400 |
| Hydrogen Purity, mol% $H_2$ | 90 |
| Operating Temperature,°F | 650–750 |

Reactor effluent product is quickly cooled to 150°F and routed to a high pressure receiver. This receiver vents gas continuously under automatic pressure control and concurrently allows liquid product to be withdrawn under automatic level control. A chemical analysis run on a composite sample of the liquid phase withdrawn from the high pressure receiver indicates that the hydrogen to carbon atomic ratio is about 1.5. In addition, the sulfur and ash contents are <0.25 and 0.04 wt% respectively. In summary the liquid product generated in this example is a high quality synthetic crude oil.

The present invention is particularly advantageous in that synthetic crude is effectively produced from coal. In effecting the hydrogen addition in two stages, with ash being separated between the stages, hydrogen is efficiently added to the coal to produce the synthetic crude. In addition, the life of the second stage catalyst is increased. Furthermore, the cost of removing ash is minimized.

Numerous modification and variations of the present invention are possible in light of the above teachings and, therefore, within the scope of the appended claims the invention may be practiced otherwise than as particularly described.

We claim:

1. A process for producing synthetic crude oil from coal, comprising:

a. contacting coal in admixture with a coal liquefaction solvent with hydrogen to effect hydrogenation thereof, said hydrogenation being effected with a hydrogen consumption of from 4,000 to 12,000 SCF/ton MAF coal, a temperature of from 650°F to 900°F and a pressure of from 500 psig to 4,000 psig.

b. introducing liquefied coal, containing insoluble material and a liquid promoter into a gravity settling zone to separate insoluble material by gravity settling, said liquid promoter having a 5 volume percent distillation temperature of at least about 250°F and a 95 volume percent distillation temperature of at least about 350°F and no greater than about 750°F, said liquid having a characterization factor (K) of at least 9.75, said liquid having a characterization factor greater than said coal liquefaction solvent, said promoter liquid being added in an amount sufficient to promote and enhance gravity settling of insoluble material to produce, as overflow, liquefied coal essentially free of insoluble material;

c. recovering from the settling zone a liquefied coal essentially free of insoluble material; and d. catalytically hydrogenating at least a portion of the liquefied coal which is essentially free of insoluble material to produce a synthetic crude oil having a hydrogen to carbon atomic ratio of from about 1.2 to about 1.8, said catalytic hydrogenation being effected at a hydrogen consumption of from about 7500 to about 20,000SCF/ton of MAF coal, a temperature of from about 500°F to about 900°F and a pressure of from about 500 to about 5000 psig.

2. The process of claim 1 wherein the gravity settling is effected at a temperature from about 300°F. to about 600°F. and a pressure from about 0 to about 500 psig.

3. The process of claim 2 wherein the promoter liquid has a characterization factor of at least 11.0.

4. The process of claim 3 wherein the promoter liquid is a kerosene fraction having a 5 volume percent distillation temperature of no less than about 425°F. and a 95 volume percent distillation temperature of no greater than about 500°F.

5. The process of claim 4 wherein step (a) is effected in an upflow ebullating bed comprising a hydroliquefaction catalyst.

6. The process of claim 4 wherein net 300°F+ liquefied coal essentially free of insoluble material is employed as feed to step (c).

7. The process of claim 6 wherein the crude oil has a 10 volume percent distillation temperature of at least 90°F and a 70 volume percent distillation temperature of no greater than 900°F.

8. The process of claim 6 wherein the liquid promoter is at least one member selected from the group consisting of kerosene, kerosene fractions, middle distillates, light gas oils, gas oil fractions, heavy naphthas, white oils and white oil fractions, all derived from crude oils.

9. The process of claim 8 and further comprising withdrawing a solid containing underflow from the gravity settling zone; stripping components boiling below about 900°F from the underflow; and employing at least a portion of the stripped components in step (d).

10. A process for producing synthetic crude oil from coal, comprising:

a. contacting coal in admixture with a liquefaction solvent with hydrogen, said contacting being effected at a temperature from about 650°F to about 900°F, at a pressure from about 500 psig to about 4,000 psig and with a hydrogen consumption of about 15,000 SCF/ton MAF coal;

b. introducing liquefied coal containing insoluble material and a liquid promoter into a gravity settling zone, said liquid promoter having a 5 volume percent distillation temperature of at least about 250°F and a 95 volume percent distillation temperature of at least about 350°F and no greater than about 750°F, said liquid having a characterization factor (K) of at least about 9.75, said liquid having a characterization factor K greater than said coal liquefaction solvent and being present in an amount sufficient to promote and enhance gravity settling of insoluble material to produce a net liquefied coal product from said coal feed containing less than about 0.1 percent, by weight, insoluble material and a coal residue containing no greater than about 40 percent, by weight, of the MAF coal feed as an ash free +850°F fraction;

c. recovering from the settling zone liquefied coal product essentially free of insoluble material; and d. catalytically hydrogenating at least a portion of the liquefied coal which is essentially free of insoluble material, said catalytic hydrogenation being effected at a temperature from about 500°F to about 900°F, a pressure from about 500 to about 5000 psig and a hydrogen consumption from about 7500 to about 20,000 SCF/ton of MAF coal feed to produce a synthetic crude oil having a hydrogen to carbon atomic ratio of from about 1.2 to about 1.8, a 10 volume percent distillation temperature of at least 90°F and a 70 volume percent distillation temperature of no greater than 900°F.

11. The process of claim 10 wherein the promoter liquid is a kerosene fraction having a 5 volume percent distillation temperature of no less than about 425°F. and a 95 volume percent distillation temperature of no greater than about 500°F.

12. The process of claim 10 wherein the promoter liquid has a characterization factor of at least 11.0.

13. The process of claim 10 wherein the liquid promoter is at least one member selected from the group consisting of kerosene, kerosene fractions, middle distillates, light gas oils, gas oil fractions, heavy naphthas, white oils and white oil fractions, all derived from crude oils.

14. The process of claim 13 and further comprising withdrawing a solid containing underflow from the gravity settling zone; stripping components boiling below about 900°F from the underflow; and employing at least a portion of the stripped components in step (d).

* * * * *